US011745306B2

(12) United States Patent
Owada et al.

(10) Patent No.: US 11,745,306 B2
(45) Date of Patent: Sep. 5, 2023

(54) POLISHING APPARATUS AND METHOD OF CONTROLLING INCLINATION OF STATIONARY RING

(71) Applicant: Ebara Corporation, Tokyo (JP)

(72) Inventors: Tomoko Owada, Tokyo (JP); Makoto Fukushima, Tokyo (JP); Keisuke Namiki, Tokyo (JP); Osamu Nabeya, Tokyo (JP); Shingo Togashi, Tokyo (JP); Satoru Yamaki, Tokyo (JP); Yoshikazu Kato, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 806 days.

(21) Appl. No.: 16/724,504

(22) Filed: Dec. 23, 2019

(65) Prior Publication Data

US 2020/0206868 A1 Jul. 2, 2020

(30) Foreign Application Priority Data

Dec. 27, 2018 (JP) ..... 2018-244439

(51) Int. Cl.
*B24B 49/04* (2006.01)
*B24B 41/047* (2006.01)

(52) U.S. Cl.
CPC ..... *B24B 49/045* (2013.01); *B24B 41/047* (2013.01)

(58) Field of Classification Search
CPC ..... B24B 49/04; B24B 49/02; B24B 49/03; B24B 49/045; B24B 49/06; B24B 37/005; B24B 37/013; B24B 37/04; B24B 37/042; B24B 37/07; B24B 37/10; B24B 37/102; B24B 37/107; B24B 37/105; B24B 37/12; B24B 37/30; B24B 37/32; B24B 37/345; B24B 9/065; B24B 7/228; B24B 41/047
See application file for complete search history.

(56) References Cited

U.S. PATENT DOCUMENTS 6,110,025 A * 8/2000 Williams ..... B24B 49/16 451/286
6,220,945 B1 * 4/2001 Hirokawa ..... B24B 49/16 451/287

(Continued)

FOREIGN PATENT DOCUMENTS

JP 2007-268654 A 10/2007
JP 2014-004675 A 1/2014
JP 2015-233131 A 12/2015

*Primary Examiner* — Joel D Crandall
*Assistant Examiner* — Makena S Markman
(74) *Attorney, Agent, or Firm* — Venjuris, P.C.

(57) ABSTRACT

A polishing apparatus includes a rotatable head body having a pressing surface, a retainer ring configured to press a polishing surface while rotating together with the head body, a stationary ring, local load applying devices configured to apply a local load to the stationary ring, and a controller. The local load applying devices include a first pressing member and a second pressing member connected to the stationary ring. The first pressing member is disposed in the upstream side of the retainer ring in the traveling direction of the polishing surface, and the second pressing member is disposed in the downstream side. The controller calculates the inclination angle of the stationary ring based on a measured value of the height of at least one of the first pressing member and the second pressing member.

7 Claims, 8 Drawing Sheets

(56) References Cited

U.S. PATENT DOCUMENTS

| | | | | |
|---|---|---|---|---|
| 6,354,907 | B1 * | 3/2002 | Satoh | B24B 49/10 451/63 |
| 6,579,151 | B2 * | 6/2003 | Tseng | B24B 37/32 451/287 |
| 9,403,255 | B2 * | 8/2016 | Fukushima | B24B 49/16 |
| 2015/0328743 | A1 * | 11/2015 | Nabeya | B24B 41/007 451/288 |

* cited by examiner

POLISHING APPARATUS AND METHOD OF CONTROLLING INCLINATION OF STATIONARY RING

CROSS-REFERENCE TO RELATED APPLICATIONS

This application is based on and claims priority from Japanese Patent Application No. 2018-244439, filed on Dec. 27, 2018, with the Japan Patent Office, the disclosure of which is incorporated herein in their entireties by reference.

TECHNICAL FIELD

The present disclosure relates to a polishing apparatus that polishes a substrate such as a wafer, and more particularly to a polishing apparatus having a retainer ring surrounding a substrate. The present disclosure also relates to a method of controlling the inclination of a stationary ring disposed above the retainer ring.

BACKGROUND

Accompanied with higher integration and higher density of semiconductor devices, circuit wiring has become increasingly finer and the number of layers of multilayer wiring has increased. When a multilayer wiring is implemented while miniaturizing the circuit, the steps become larger while following the surface unevenness of a lower layer. Therefore, as the number of wiring layers increases, the film coatability (step coverage) with respect to the step shape in thin film formation deteriorates. Accordingly, in order to carry out a multilayer wiring, it is necessary to improve the step coverage and perform a planarization processing in an appropriate process. Further, since the depth of focus becomes shallower as optical lithography becomes finer, it is necessary to planarize the surface of a semiconductor device so that uneven steps on the surface of the semiconductor device are kept below the depth of focus.

Thus, in a semiconductor device manufacturing process, the planarization of the surface of the semiconductor device has become increasingly important. One of the most important techniques in the planarization of the surface is chemical mechanical polishing (CMP). The chemical mechanical polishing (hereinafter referred to as CMP) performs a polishing by bringing a substrate such as a wafer into a sliding contact with the polishing surface of a polishing pad while supplying a polishing liquid (slurry) containing abrasive particles such as silica ($SiO_2$) onto the polishing surface.

A polishing apparatus for performing CMP includes a polishing table which supports a polishing pad having a polishing surface and a polishing head for holding a substrate. Polishing of the substrate using such a polishing apparatus is performed as follows. Slurry is supplied onto the polishing pad while rotating the polishing table together with the polishing pad. The polishing head presses the substrate against the polishing surface of the polishing pad while rotating the substrate. While the substrate is brought into a sliding contact with the polishing pad under the presence of the slurry, the surface of the substrate is planarized by a combination of the chemical action of the slurry and the mechanical action of the abrasive particles contained in the slurry.

During the polishing of the substrate, the surface of the substrate is brought into a sliding contact with the rotating polishing pad, so that a frictional force acts on the substrate. Therefore, in order to prevent the substrate from being detached from the polishing head during the polishing of the substrate, the polishing head is provided with a retainer ring. Since the retainer ring is disposed so as to surround the substrate, the retainer ring presses the polishing pad outside the substrate while rotating during the polishing of the substrate. In addition to the role of preventing the substrate from being detached from the polishing head during the polishing of the substrate, the retainer ring also has a role of controlling the polishing profile of an edge portion of the substrate (see, e.g., Japanese Patent Laid-Open Publication Nos. 2014-004675, 2015-233131 and 2007-268654).

SUMMARY

Since the retainer ring presses the polishing pad around the substrate, the amount of pressing of the retainer ring onto the polishing pad affects the polishing profile of the edge portion of the substrate. In order to positively control the polishing profile of the edge portion of the substrate, a local load may be applied to a portion of the retainer ring to positively tilt the retainer ring with respect to the substrate. The inclination angle of the retainer ring greatly affects the polishing profile of the edge portion. Accordingly, in order to accurately control the polishing profile of the edge portion, it is required to accurately control the angle of the retainer ring during the polishing of the substrate.

Therefore, the present disclosure provides a polishing apparatus capable of accurately controlling the inclination of a retainer ring. Furthermore, the present disclosure provides a method of accurately controlling the inclination of a retainer ring.

In one aspect, there is provided a polishing apparatus including a rotatable head body having a pressing surface configured to press a substrate against a polishing surface, a retainer ring disposed to surround the pressing surface and configured to press the polishing surface while rotating together with the head body, a rotational ring fixed to the retainer ring and configured to be rotatable together with the retainer ring, a stationary ring disposed on the rotational ring, a plurality of local load applying devices each configured to apply a local load to the stationary ring, and a controller, in which each of the plurality of local load applying devices include a first pressing member and a second pressing member connected to the stationary ring, a first actuator and a second actuator connected to the first pressing member and the second pressing member, respectively, and at least one displacement sensor configured to measure a height of at least one of the first pressing member and the second pressing member, the first pressing member is disposed in an upstream side of the retainer ring in a traveling direction of the polishing surface and the second pressing member is disposed in a downstream side of the retainer ring in the traveling direction of the polishing surface, and the controller is configured to calculate an inclination angle of the stationary ring based on a measured value of the height of at least one of the first pressing member and the second pressing member during polishing of the substrate.

In one aspect, the at least one displacement sensor includes a first displacement sensor and a second displacement sensor that measure respective heights of the first pressing member and the second pressing member, and the controller is configured to calculate the inclination angle of the stationary ring based on a difference between a measured value of the height of the first pressing member and a measured value of the height of the second pressing member during polishing of the substrate.

In one aspect, the controller is configured to issue a command to at least one of the first actuator and the second actuator so as to adjust the local load applied to the stationary ring from at least one of the first pressing member and the second pressing member until the inclination angle of the stationary ring falls within a target range.

In one aspect, there is provided a method including pressing a substrate against a polishing surface by a pressing surface while rotating a head body having the pressing surface, pressing a retainer ring disposed so as to surround the substrate against the polishing surface while rotating the retainer ring together with the head body and the substrate, applying a local load from a first pressing member or a second pressing member to a stationary ring disposed on a rotational ring while rotating the rotational ring fixed to the retainer ring together with the retainer ring, calculating an inclination angle of the stationary ring based on a measured value of a height of at least one of the first pressing member and the second pressing member acquired during polishing of the substrate, and adjusting the local load applied to the stationary ring from at least one of the first pressing member and the second pressing member during polishing of the substrate until the inclination angle falls within a target range.

In one aspect, the calculating the inclination angle of the stationary ring is calculating the inclination angle of the stationary ring based on a difference between the measured value of the height of the first pressing member and the measured value of the height of the second pressing member during polishing of the substrate.

In one reference example, there is provided a polishing apparatus including a rotatable head body having a pressing surface configured to press a substrate against a polishing surface, a retainer ring disposed so as to surround the pressing surface and configured to press the polishing surface while rotating together with the head body, a rotational ring fixed to the retainer ring so as to be rotatable with the retainer ring, a stationary ring disposed on the rotational ring, a plurality of local load applying devices configured to apply a local load to the stationary ring, and a controller, wherein the plurality of local load applying devices include a first pressing member and a second pressing member connected to the stationary ring, a first actuator and a second actuator respectively connected to the first pressing member and the second pressing member, and at least one displacement sensor configured to measure a height of at least one of the first pressing member and the second pressing member, wherein the first pressing member is disposed in an upstream side of the retainer ring in a traveling direction of the polishing surface and the second pressing member is disposed in a downstream side of the retainer ring in the traveling direction of the polishing surface, and wherein the controller has an inclination calculation program that causes the controller to execute calculation of an inclination angle of the stationary ring based on a measured value of the height of at least one of the first pressing member and the second pressing member during polishing of the substrate.

In one reference example, the at least one displacement sensor includes a first displacement sensor and a second displacement sensor that measure respective heights of the first pressing member and the second pressing member, and the inclination calculation program is a program that causes the controller to execute calculation of the inclination angle of the stationary ring based on a difference between a measured value of the height of the first pressing member and a measured value of the height of the second pressing member during polishing of the substrate.

In one reference example, the controller further includes a load adjustment program that causes the controller to issue a command to at least one of the first actuator and the second actuator so as to adjust the local load applied to the stationary ring from at least one of the first pressing member and the second pressing member until the inclination angle of the stationary ring falls within a target range.

According to the present disclosure, the inclination angle of a stationary ring is calculated based on the height of at least one of the pressing members connected to the stationary ring. The inclination angle of the stationary ring is substantially the same as the inclination angle of a retainer ring. Thus, a polishing apparatus may accurately control the inclination of the retainer ring based on the inclination angle of the stationary ring.

The foregoing summary is illustrative only and is not intended to be in any way limiting. In addition to the illustrative aspects, embodiments, and features described above, further aspects, embodiments, and features will become apparent by reference to the drawings and the following detailed description.

DESCRIPTION OF EMBODIMENT

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Figure 1:
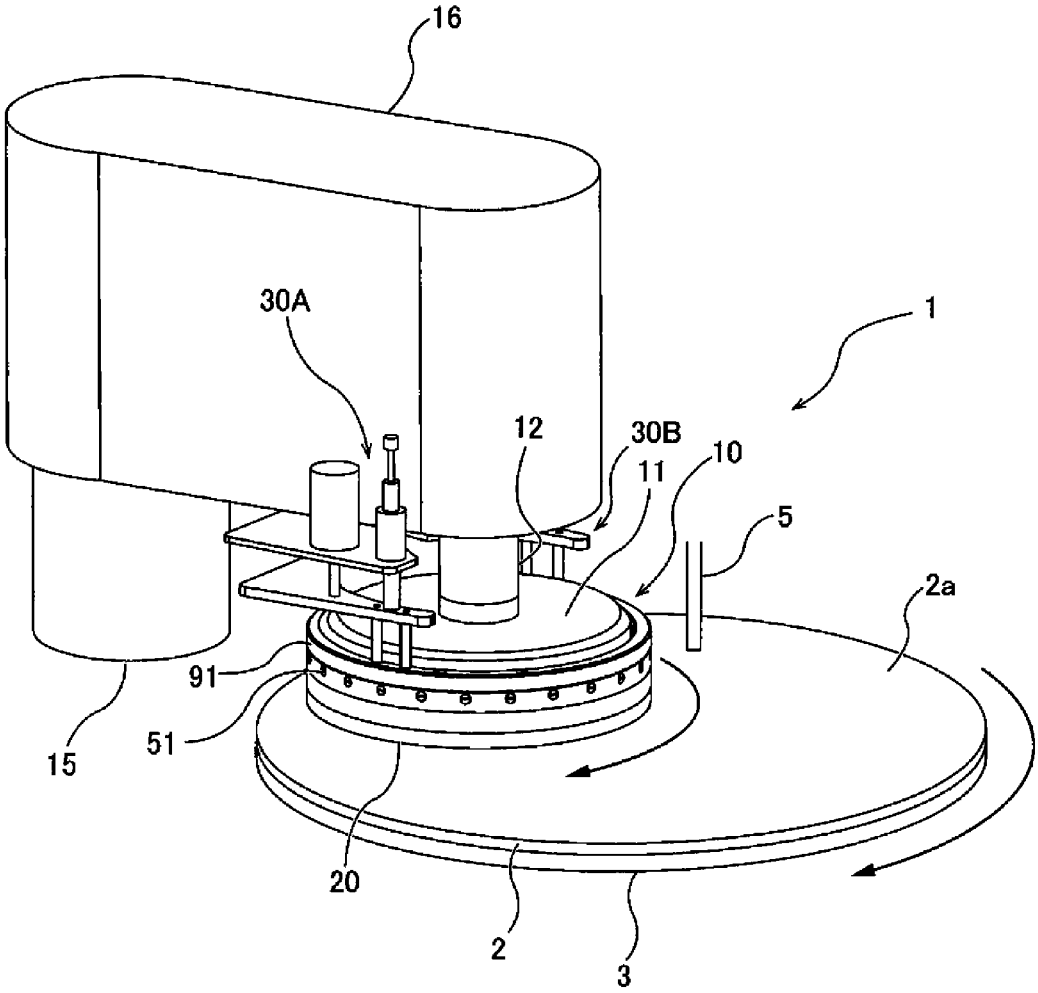
FIG. 1 is a schematic view illustrating an embodiment of a polishing apparatus.

Hereinafter, embodiments of the present disclosure will be described in detail with reference to the drawings. FIG. 1 is a schematic view illustrating an embodiment of a polishing apparatus. As illustrated in FIG. 1, the polishing apparatus 1 includes a polishing head 10 which holds and rotates a wafer that is an example of a substrate, a polishing table 3 which supports a polishing pad 2, and a polishing liquid supply nozzle 5 which supplies a polishing liquid (slurry) to the polishing pad 2. The upper surface of the polishing pad 2 constitutes a polishing surface 2*a* which polishes the wafer. The polishing pad 2 is configured to rotate integrally with the polishing table 3.

The polishing head 10 is connected to the lower end of a polishing head shaft 12. The polishing head shaft 12 is rotatably held by a head arm 16. A rotating device (not illustrated) that rotates the polishing head shaft 12 and a lifting device (not illustrated) that raises and lowers the polishing head shaft 12 are disposed in the head arm 16. The polishing head 10 is rotated via the polishing head shaft 12 by the rotating device. The polishing head 10 is raised and lowered via the polishing head shaft 12 by the lifting device. The head arm 16 is fixed to a pivot shaft 15, and it is possible to move the polishing head 10 to the outside of the polishing table 3 by the rotation of the pivot shaft 15.

The polishing head 10 is configured to be able to hold the wafer on the lower surface thereof by vacuum suction. The polishing head 10 and the polishing table 3 (polishing pad 2) rotate in the same direction as indicated by arrows, and in this state, the polishing head 10 presses the wafer against the polishing surface 2*a* of the polishing pad 2. The polishing liquid is supplied from the polishing liquid supply nozzle 5 onto the polishing surface 2*a* of the polishing pad 2, and the wafer is polished by sliding contact with the polishing surface 2*a* under the presence of the polishing liquid.

The polishing head 10 includes a head body 11 which presses the wafer against the polishing pad 2 and a retainer ring 20 disposed so as to surround the wafer. The head body 11 and the retainer ring 20 are configured to rotate integrally with the polishing head shaft 12. The retainer ring 20 is configured to be movable up and down independently of the head body 11. The retainer ring 20 protrudes outward from the head body 11 in the radial direction. During the polishing of the wafer, the retainer ring 20 is in contact with the polishing surface 2*a* of the polishing pad 2 and presses the polishing pad 2 outside the wafer while rotating.

The polishing head 10 further includes a rotational ring 51 in which a plurality of rollers (to be described later) are disposed and a stationary ring 91. The rotational ring 51 is fixed to the upper surface of the retainer ring 20 and is configured to be rotatable together with the retainer ring 20. The stationary ring 91 is disposed on the rotational ring 51. The rotational ring 51 rotates together with the retainer ring 20, but the stationary ring 91 does not rotate and is stationary.

The polishing apparatus 1 further includes a first local load applying device 30A which applies a local load to a portion of the retainer ring 20 and a second local load applying device 30B which applies a local load to a portion of the retainer ring 20. The local load applying devices 30A and 30B are disposed above the retainer ring 20. The local load applying devices 30A and 30B are fixed to the head arm 16. During polishing, the retainer ring 20 rotates around the axis thereof, but the local load applying devices 30A and 30B do not rotate integrally with the retainer ring 20 and are stationary. The stationary ring 91 is connected to the local load applying devices 30A and 30B. The first local load applying device 30A is disposed in the upstream side of the retainer ring 20 in the traveling direction of the polishing surface 2*a* of the polishing pad 2 (one side of the retainer ring 20 into which the polishing surface 2*a* is introduced), and the second local load applying device 30B is disposed on the downstream side of the retainer ring 20 in the traveling direction of the polishing surface 2*a* of the polishing pad 2 (opposite side of the retainer ring 20 from which the polishing surface 2*a* is discharged).

Figure 2:
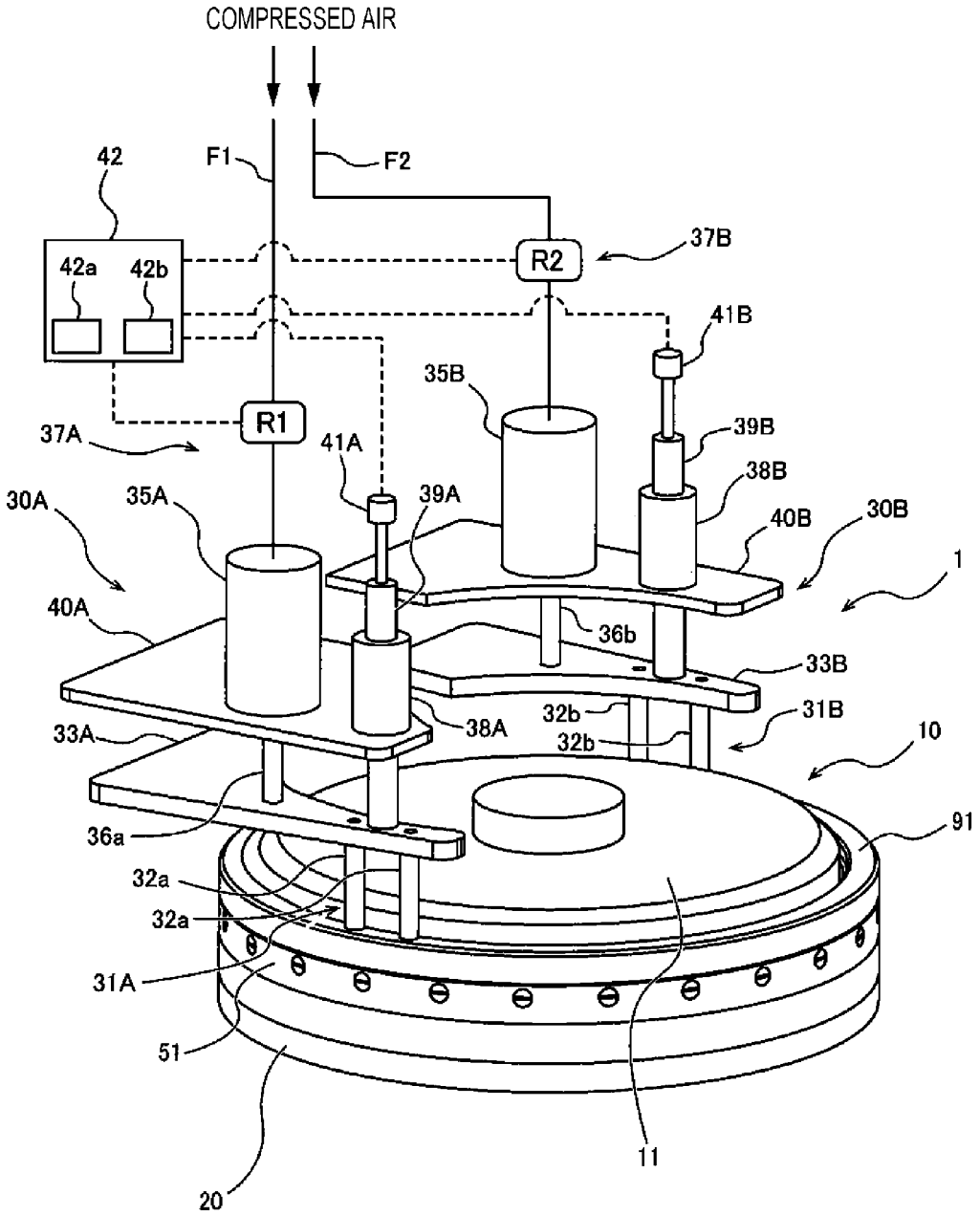
FIG. 2 is a perspective view illustrating a local load applying device.

FIG. 2 is a perspective view illustrating the local load applying devices 30A and 30B. As illustrated in FIG. 2, the plurality of local load applying devices 30A and 30B respectively include a plurality of pressing members 31A and 31B which apply a downward local load to the stationary ring 91, a plurality of bridges 33A and 33B, a plurality of air cylinders 35A and 35B which generate a downward force, a plurality of pressure regulators R1 and R2 which adjust the pressure of compressed gas in the air cylinders 35A and 35B, a plurality of linear guides 38A and 38B, a plurality of guide rods 39A and 39B, a plurality of unit bases 40A and 40B, and a plurality of displacement sensors 41A and 41B which measure the heights (vertical positions) of the respective pressing members 31A and 31B.

Specifically, the first local load applying device 30A includes the first pressing member 31A, the first bridge 33A, the first air cylinder 35A, the first pressure regulator R1, the first linear guide 38A, the first guide rod 39A, the first unit base 40A, and the first displacement sensor 41A. The second local load applying device 30B includes the second pressing member 31B, the second bridge 33B, the second air cylinder 35B, the second pressure regulator R2, the second linear guide 38B, the second guide rod 39B, the second unit base 40B, and the second displacement sensor 41B.

A piston rod 36*a* of the first air cylinder 35A is connected to the first pressing member 31A via the first bridge 33A, and the end of the first pressing member 31A is connected to the stationary ring 91. Thus, the force generated by the first air cylinder 35A is transmitted to the first pressing member 31A, and the first pressing member 31A applies a local load to a portion of the stationary ring 91. Similarly, a piston rod 36*b* of the second air cylinder 35B is connected to the second pressing member 31B via the second bridge 33B, and the end of the second pressing member 31B is connected to the stationary ring 91. Thus, the force generated by the second air cylinder 35B is transmitted to the second pressing member 31B, and the second pressing member 31B applies a local load to a portion of the stationary ring 91.

In the present embodiment, a combination of the first air cylinder 35A and the first pressure regulator R1 constitutes a first actuator 37A which adjusts the local load applied to the stationary ring 91 from the first pressing member 31A, and a combination of the second air cylinder 35B and the second pressure regulator R2 constitutes a second actuator 37B which adjusts the local load applied to the stationary ring 91 from the second pressing member 31B. In one embodiment, each of the first actuator 37A and the second actuator 37B may be constituted by a combination of a servo motor, a ball screw mechanism, and a motor driver.

The first pressing member 31A includes two pressing rods 32*a*, and the second pressing member 31B includes two pressing rods 32*b*. The pressing rods 32*a* and the pressing rods 32*b* are connected to the stationary ring 91. The first pressing member 31A is connected to the stationary ring 91 on the upstream side of the retainer ring 20 in the traveling direction of the polishing surface 2*a* of the polishing pad 2, and the second pressing member 31B is connected to the stationary ring 91 on the downstream side of the retainer ring 20 in the traveling direction of the polishing surface 2*a* of the polishing pad 2.

The local load applying devices 30A and 30B are fixed to the head arm 16 illustrated in FIG. 1 via the unit bases 40A and 40B. Thus, during the polishing of the wafer, the polishing head 10 and the wafer are rotating while the local load applying devices 30A and 30B are stationary. Similarly, during the polishing of the wafer, the rotational ring 51 is rotating together with the polishing head 10 while the stationary ring 91 is stationary.

The local load applying devices 30A and 30B have the same configuration. The following description relates to the first local load applying device 30A, but is also similarly applied to the second local load applying device 30B. The first air cylinder 35A and the first linear guide 38A are mounted to the first unit base 40A. The piston rod 36*a* of the first air cylinder 35A and the first guide rod 39A are connected to the first bridge 33A. The first guide rod 39A is supported by the first linear guide 38A so as to be movable up and down with low friction. The first linear guide 38A allows the first bridge 33A to be smoothly movable up and down without tilting.

The first displacement sensor 41A is fixed to the head arm 16 illustrated in FIG. 1. In one embodiment, the first displacement sensor 41A may be mounted to a bracket (not illustrated) fixed to the first unit base 40A. The first displacement sensor 41A is connected to the first pressing member 31A via the first guide rod 39A and the first bridge 33A. The first displacement sensor 41A is configured to measure the height of the first pressing member 31A. The height of the first pressing member 31A is defined as the height of the first pressing member 31A from a certain reference point.

In the present embodiment, a contact-type displacement sensor such as a linear scale is used as the first displacement sensor 41A. However, in one embodiment, a non-contact-type displacement sensor may be used. Examples of the non-contact-type displacement sensor may include an optical displacement sensor, an ultrasonic displacement sensor, an eddy current displacement sensor, and an inductive proximity sensor.

The air cylinders 35A and 35B are connected to a compressed gas supply source (not illustrated) via gas transfer lines F1 and F2. The pressure regulators R1 and R2 are provided in the gas transfer lines F1 and F2, respectively. The compressed gas from the compressed gas supply source passes through the pressure regulators R1 and R2 and is independently supplied to the respective air cylinders 35A and 35B.

The pressure regulators R1 and R2 are configured to adjust the pressure of the compressed gas in the air cylinders 35A and 35B. The pressure regulators R1 and R2 may change the pressure of the compressed gas in the air cylinders 35A and 35B independently of each other, so that the air cylinders 35A and 35B may generate a force independently of each other.

The force generated by the air cylinders 35A and 35B is transmitted to the respective bridges 33A and 33B. The bridges 33A and 33B are connected to the stationary ring 91 via the pressing members 31A and 31B, and the pressing members 31A and 31B transmit the force of the air cylinders 35A and 35B, applied to the bridges 33A and 33B, to the stationary ring 91. That is, the first pressing member 31A presses a portion of the stationary ring 91 with a local load corresponding to the force generated by the first air cylinder 35A, and the second pressing member 31B presses a portion of the stationary ring 91 with a local load corresponding to the force generated by the second air cylinder 35B.

Each of the local load applying devices 30A and 30B applies a downward local load to a portion of the retainer ring 20 through the stationary ring 91 and the rotational ring 51. That is, the downward local load is transmitted to the retainer ring 20 through the stationary ring 91 and the rotational ring 51. The reason why the downward local load is applied to a portion of the retainer ring 20 during the polishing of the wafer is to positively tilt the retainer ring 20 to control the polishing profile of a peripheral portion (edge portion) of the wafer. The downward local load changes the inclination of the retainer ring 20 to change the amount of local pressing of the retainer ring 20 onto the polishing pad 2. By controlling the inclination of the retainer ring 20, the polishing profile of the peripheral portion (edge portion) of the wafer may be controlled.

As described above, the rotational ring 51 is fixed to the upper surface of the retainer ring 20, and the stationary ring 91 is disposed on the rotational ring 51. Thus, the local load applying devices 30A and 30B may indirectly control the inclination of the retainer ring 20 by controlling the inclination of the stationary ring 91. The amount of pressing of the retainer ring 20 onto the polishing pad 2 changes according to the local load applied to the stationary ring 91 from the pressing members 31A and 31B, and the inclination of the stationary ring 91 and the heights (vertical positions) of the pressing members 31A and 31B change according to the amount of pressing. Thus, the local load applying devices 30A and 30B may control the inclination of the stationary ring 91 by controlling the local load applied from the pressing members 31A and 31B to the stationary ring 91.

The polishing apparatus 1 further includes a controller 42. The controller 42 includes a storage unit 42*a* which stores data and a program and an arithmetic processing unit 42*b* which executes an arithmetic operation according to the program. The controller 42 operates according to the program stored in the storage unit 42*a*. A dedicated computer or a general-purpose computer may be used as the controller 42.

In the present embodiment, the storage unit 42*a* stores an inclination calculation program that causes the controller 42 to execute a step of calculating the inclination angle of the stationary ring 91 based on a measured value of the height of at least one of the first pressing member 31A and the second pressing member 31B acquired during the polishing of the wafer and a load adjustment program that causes the controller 42 to execute a step of adjusting the local load applied to the stationary ring 91 from at least one of the first pressing member 31A and the second pressing member 31B until the inclination angle of the stationary ring 91 falls within a target range by issuing a command to at least one of the first actuator 37A and the second actuator 37B.

The controller 42 calculates, according to the inclination calculation program, the inclination angle of the stationary ring 91 based on the measured value of the height of at least one of the first pressing member 31A and the second pressing member 31B acquired during the polishing of the wafer. Furthermore, the controller 42 adjusts, according to the load adjustment program, the pressure of the compressed gas in the air cylinder 35A or the air cylinder 35B by issuing a command to at least one of the pressure regulators R1 and R2 during the polishing of the wafer until the inclination angle of the stationary ring 91 falls within a preset target range, thereby adjusting the local load to be transmitted to the stationary ring 91 from at least one of the pressing members 31A and 31B.

The displacement sensors 41A and 41B are connected to the controller 42 and are configured to transmit the measured value of the height of the first pressing member 31A and the measured value of the height of the second pressing member 31B to the controller 42. The inclination calculation program of the present embodiment is a program that causes the controller 42 to execute the step of calculating the inclination angle of the stationary ring 91 based on the difference between the measured value of the height of the first pressing member 31A and the measured value of the height of the second pressing member 31B acquired during the polishing of the wafer. The controller 42 calculates the inclination angle of the stationary ring 91 based on the difference between the measured value of the height of the first pressing member 31A and the measured value of the height of the second pressing member 31B acquired during the polishing of the wafer. The inclination angle of the stationary ring 91 may be calculated from the distance between the first pressing member 31A and the second pressing member 31B and the difference between the measured values of the heights of the pressing members 31A and 31B.

In one embodiment, the inclination calculation program may be a program that causes the controller 42 to execute the step of calculating the inclination angle of the stationary ring 91 based on the height of a preselected one of the pressing members 31A and 31B acquired during the polishing of the wafer. Specifically, the inclination calculation program causes the controller 42 to execute the step of calculating the inclination angle of the stationary ring 91 based on the difference between a reference height and the measured value of the height of a preselected one of the first pressing member 31A and the second pressing member 31B during the polishing of the wafer (when the retainer ring 20 is in contact with the polishing surface 2*a*). The reference height is a predetermined height based on a desired polishing profile. In this case, the polishing apparatus 1 may include only one of the displacement sensors 41A and 41B.

In one embodiment, the polishing apparatus may further include one or more displacement sensors in addition to the above-described local load applying devices 30A and 30B. When the polishing apparatus includes three or more displacement sensors, the controller 42 may calculate the flatness of the stationary ring 91. By calculating the flatness, an appropriate position of the stationary ring 91 to which a local load is applied may be determined based on the calculated flatness. Further, in one embodiment, the pressing members 31A and 31B may be provided so as to be movable in the circumferential direction of the stationary ring 91. By providing the pressing members 31A and 31B so as to be movable, the pressing members 31A and 31B may apply a local load to the determined position of the stationary ring 91.

Figure 3:
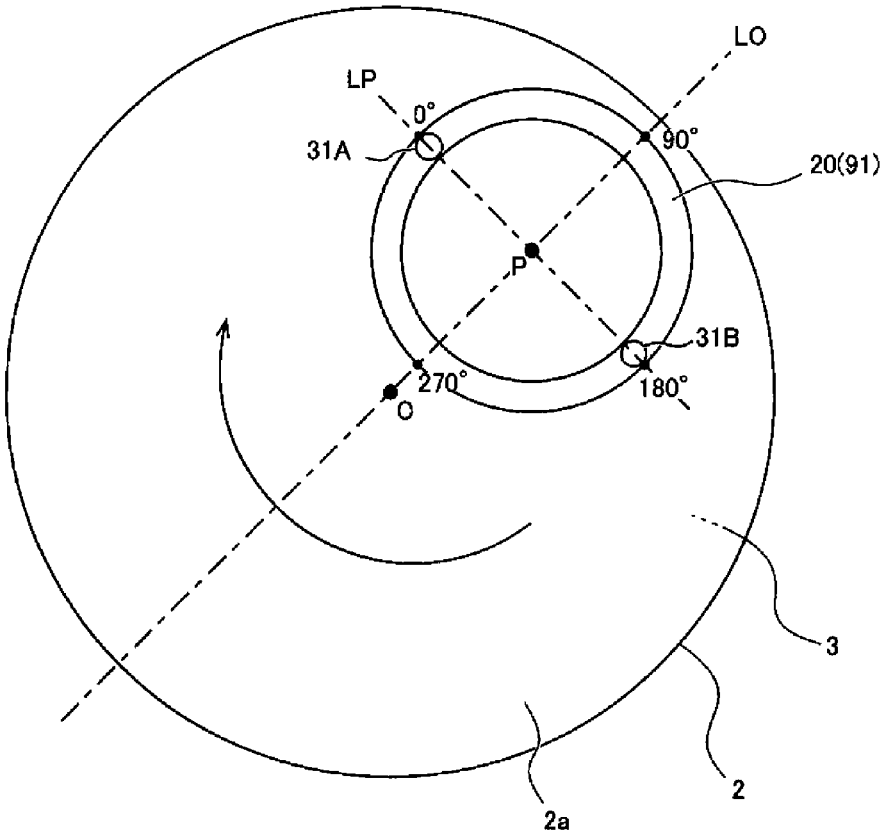
FIG. 3 is a top view schematically illustrating a positional relationship between a retainer ring and a pressing member.

FIG. 3 is a top view schematically illustrating a positional relationship between the retainer ring 20 and the pressing members 31A and 31B. The arrow in FIG. 3 indicates the traveling direction of the polishing surface 2*a*. Assuming that a straight line that passes through the center P of the retainer ring 20 and the center O of the polishing table 3 is a reference straight line LO, the polishing surface 2*a* may be divided into the upstream side of the reference straight line LO and the downstream side of the reference straight line LO with respect to the traveling direction thereof. In other words, the upstream side of the reference straight line LO and the downstream side of the reference straight line LO are the upstream side and the downstream side of the retainer ring 20 and the stationary ring 91 with respect to the traveling direction of the polishing surface 2*a*.

The first pressing member 31A and the second pressing member 31B are located on both sides of the reference straight line LO. More specifically, the first pressing member 31A is located on the upstream side of the reference straight line LO in the traveling direction of the polishing surface 2*a*, and the second pressing member 31B is located on the downstream side of the reference straight line LO in the traveling direction of the polishing surface 2*a*. In the present embodiment, the first pressing member 31A and the second pressing member 31B are disposed on a straight line LP that perpendicularly intersects with the reference straight line LO and passes through the center P.

In FIG. 3, of two intersections between the straight line LP and the outer periphery of the retainer ring 20, the intersection on the upstream side is set to an angle of 0 degrees and the intersection on the downstream side is set to an angle of 180 degrees. Of two intersections of the reference straight line LO and the outer periphery of the retainer ring 20, the intersection on the polishing surface center side is set to an angle 270 degrees and the intersection on the polishing surface outer peripheral side is set to an angle 90 degrees. In one embodiment, the first pressing member 31A may be disposed within a range of 0 degrees±30 degrees, and the second pressing member 31B may be disposed within a range of 180 degrees±30 degrees. Furthermore, in one embodiment, the first pressing member 31A may be disposed within a range of 0 degrees±60 degrees, and the second pressing member 31B may be disposed within a range of 180 degrees±60 degrees. Furthermore, in one embodiment, the first pressing member 31B may be disposed within a range of 0 degrees±90 degrees, and the second pressing member 31B may be disposed within a range of 180 degrees±90 degrees.

Figure 4:
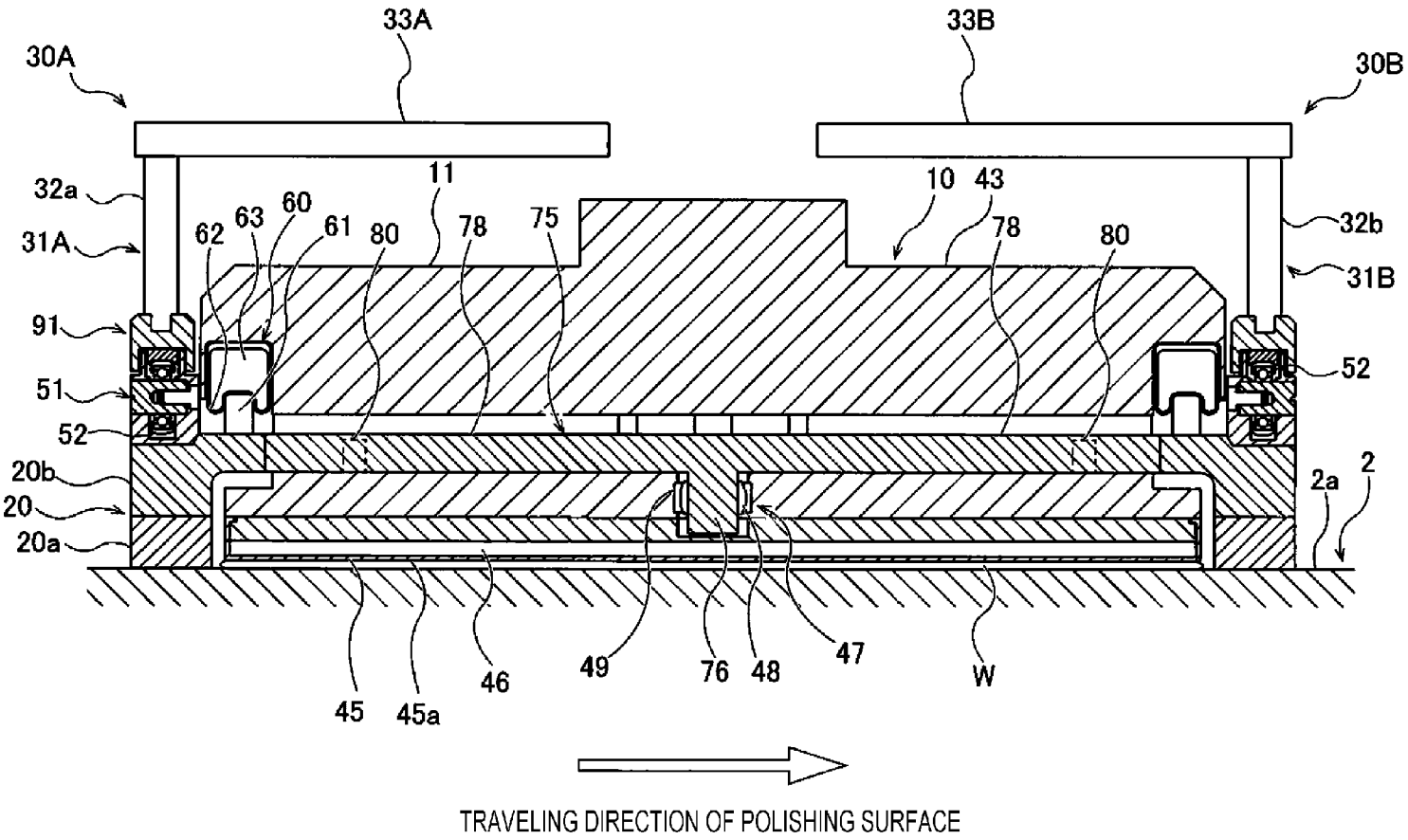
FIG. 4 is a cross-sectional view of a polishing head.

Next, details of the polishing head 10 will be described. FIG. 4 is a cross-sectional view of the polishing head 10. The polishing head 10 includes the head body 11 and the retainer ring 20. The head body 11 includes a carrier 43 connected to the polishing head shaft 12 (see FIG. 1), an elastic membrane 45 mounted to the lower surface of the carrier 43, and a spherical bearing 47 which supports the retainer ring 20 while allowing the tilting and vertical movement of the retainer ring 20 with respect to the carrier 43. The retainer ring 20 is connected to and supported by the spherical bearing 47 via a connecting member 75. The connecting member 75 is disposed so as to be movable up and down in the carrier 43.

The lower surface of the elastic membrane 45 constitutes a pressing surface 45*a*, and the pressing surface 45*a* is in contact with the upper surface of the wafer W (surface opposite to the surface to be polished). A plurality of through-holes (not illustrated) are formed in the elastic membrane 45. A pressure chamber 46 is formed between the carrier 43 and the elastic membrane 45. The pressure chamber 46 is connected to a pressure adjustment device (not illustrated). When a pressurized fluid (e.g., pressurized air) is supplied to the pressure chamber 46, the pressing surface 45*a* of the elastic membrane 45 which has received the fluid pressure in the pressure chamber 46 presses the wafer W onto the polishing surface 2*a* of the polishing pad 2. When a negative pressure is created in the pressure chamber 46, the wafer W is held on the pressing surface 45*a* of the elastic membrane 45 by vacuum suction. In one embodiment, a plurality of pressure chambers may be provided between the carrier 43 and the elastic membrane 45.

The retainer ring 20 is disposed so as to surround the wafer W and the pressing surface 45*a* of the elastic membrane 45. The retainer ring 20 includes a ring member 20*a* which comes into contact with the polishing pad 2 and a drive ring 20*b* fixed to the upper portion of the ring member 20*a*. The ring member 20*a* is coupled to the drive ring 20*b* by a plurality of bolts (not illustrated). The ring member 20*a* is disposed so as to surround the outer periphery of the wafer W and the pressing surface 45*a* of the elastic membrane 45.

The connecting member 75 includes a shaft portion 76 disposed at the center portion of the head body 11 and a plurality of spokes 78 extending radially from the shaft portion 76. The shaft portion 76 extends in the vertical direction within the spherical bearing 47 disposed at the center portion of the head body 11. The shaft portion 76 is supported by the spherical bearing 47 so as to be movable in the vertical direction. The drive ring 20*b* is connected to the spokes 78. With such a configuration, the connecting member 75 and the retainer ring 20 connected thereto may be moved in the vertical direction with respect to the head body 11.

The spherical bearing 47 includes an inner ring 48 and an outer ring 49 which slidably supports the outer peripheral surface of the inner ring 48. The inner ring 48 is connected to the retainer ring 20 via the connecting member 75. The outer ring 49 is fixed to the carrier 43. The shaft portion 76 of the connecting member 75 is supported by the inner ring 48 so as to be movable up and down. The retainer ring 20 is supported by the spherical bearing 47 via the connecting member 75 so as to be tiltable.

The spherical bearing 47 allows the retainer ring 20 to move up and down and tilt but restricts lateral movement (horizontal movement) of the retainer ring 20. During the polishing of the wafer W, the retainer ring 20 receives, 2 from the wafer W, a lateral force (force directed outward in the radial direction of the wafer W) caused by the friction between the wafer W and the polishing pad. The lateral force is received by the spherical bearing 47. As described above, the spherical bearing 47 functions as a support mechanism that restricts the lateral movement of the retainer ring 20 (i.e., fixes the horizontal position of the retainer ring 20) while receiving the lateral force (force directed outward in the radial direction of the wafer W) that the retainer ring 20 receives from the wafer W due to the friction between the wafer W and the polishing pad 2 during the polishing of the wafer W.

A plurality of pairs of drive collars 80 are fixed to the carrier 43. Each pair of drive collars 80 are disposed on both sides of each spoke 78, and the rotation of the carrier 43 is transmitted to the retainer ring 20 via the drive collars 80, so that the head body 11 and the retainer ring 20 rotate integrally with each other. The drive collars 80 are only in contact with the spoke 78 and do not prevent the connecting member 75 and the retainer ring 20 from moving up and down and tilting.

The upper portion of the retainer ring 20 is connected to an annular retainer ring pressing mechanism 60. The retainer ring pressing mechanism 60 applies a uniform downward load to the entire upper surface of the retainer ring 20 (more specifically, the entire upper surface of the drive ring 20*b*), and presses the lower surface of the retainer ring 20 (i.e., the lower surface of the ring member 20*a*) against the polishing surface 2*a* of the polishing pad 2.

The retainer ring pressing mechanism 60 includes an annular piston 61 fixed to the upper portion of the drive ring 20*b* and an annular rolling diaphragm 62 connected to the upper surface of the piston 61. A pressure chamber 63 is formed inside the rolling diaphragm 62. The pressure chamber 63 is connected to a pressure adjustment device (not illustrated). When a pressurized fluid (e.g., pressurized air) is supplied to the pressure chamber 63, the rolling diaphragm 62 pushes down the piston 61, and the piston 61 further pushes down the entire retainer ring 20. In this way, the retainer ring pressing mechanism 60 presses the lower surface of the retainer ring 20 against the polishing surface 2*a* of the polishing pad 2.

Figure 5:
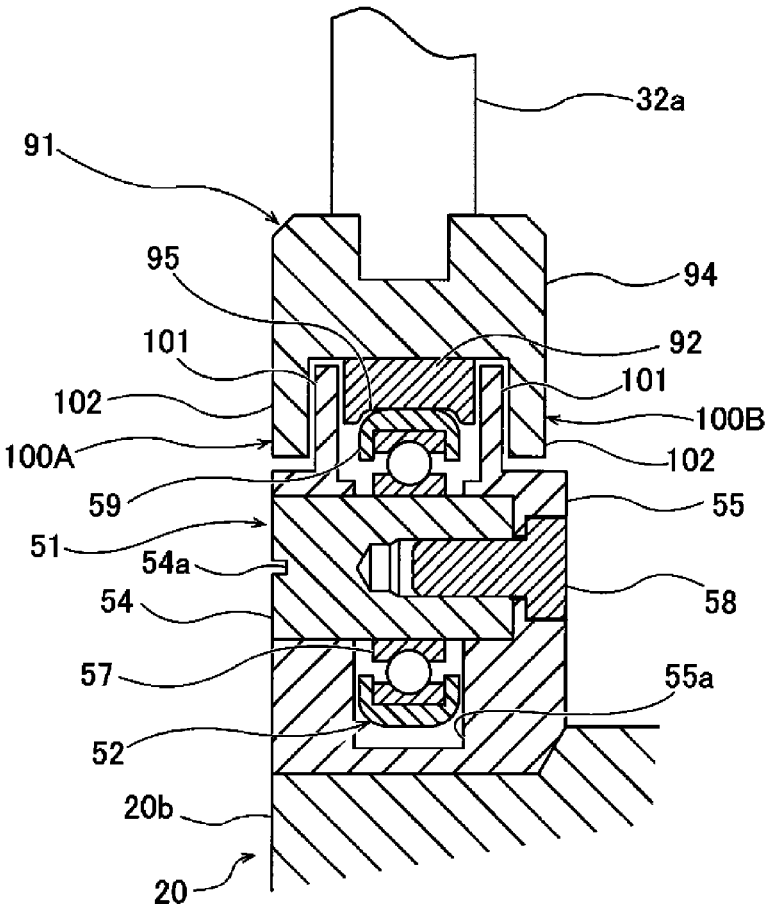
FIG. 5 is a cross-sectional view of a rotational ring and a stationary ring.

FIG. 5 is a cross-sectional view of the rotational ring 51 and the stationary ring 91. The rotational ring 51 includes a plurality of rollers 52, a roller shaft 54 that supports each of the rollers 52, and a roller housing 55 to which the roller shaft 54 is fixed. In FIG. 5, only one roller 52 and one roller shaft 54 are illustrated. The roller housing 55 has an annular shape and is fixed to the upper surface of the retainer ring 20. The roller 52 has a bearing 57 mounted to the roller shaft 54. The roller 52 is rotatable about the roller shaft 54.

The stationary ring 91 includes a circular rail 92 which comes into contact with the top of the roller 52 and a circular rail base 94 to which the circular rail 92 is fixed. An annular groove 95 is formed in the lower surface of the circular rail 92, and the top of each roller 52 is in contact with the annular groove 95. The roller 52 is configured to rotate while being in rolling contact with the circular rail 92. The pressing rods 32*a* and 32*b* (the pressing rod 32*b* being not illustrated) are connected to the upper portion of the rail base 94.

The roller shaft 54 penetrating the inner ring of the bearing 57 of the roller 52 is supported by the inner wall and the outer wall of the roller housing 55 and is fixed by a screw 58 inserted into the inner wall. Therefore, a female screw is formed in the roller shaft 54, and a groove 54*a* into which a minus driver is tightly fitted is formed on the opposite side of the female screw so as to prevent the screw 56 from idling during fastening. The rotational ring 51 is placed on the upper surface of the drive ring 20*b* of the retainer ring 20. The drive ring 20*b* and the rotational ring 51 are positioned by a positioning pin (not illustrated), and the rotational ring 51 does not slip with respect to the retainer ring 20.

The roller 52 is constituted of the bearing 57 mounted to the roller shaft 54 and a wheel 59 fixed to the outer ring of the bearing 57. The wheel 59 is formed of a resin having high wear resistance such as, for example, polyacetal, polyethylene terephthalate (PET), polyethylene sulfide (PPS), or MC nylon (registered trademark). The material of the circular rail 92 may be a metal with high corrosion resistance such as stainless steel (SUS304). A single row deep groove ball bearing is used as the bearing 57, and the wheel 59 is mounted to the bearing 57 by press-fitting the resin wheel 59 into the outer ring of the bearing 57.

An annular recess 55*a* is formed inside the roller housing 55, and the plurality of rollers 52 are accommodated in the annular recess 55*a*. The lower surface and both side surfaces of each roller 52 are surrounded by the annular recess 55*a*. Seals 100A and 100B are disposed between the roller housing 55 of the rotational ring 51 and the rail base 94 of the stationary ring 91. More specifically, the outer seal 100A is disposed outside the circular rail 92, and the inner seal 100B is disposed inside the circular rail 92. There are no openings in both side surfaces and the bottom surface constituting the annular recess 55*a*, and the seals 100A and 100B are disposed between the stationary ring 91 and the rotational ring 51. Thus, abrasion powder generated from the roller 52 and the circular rail 92 is confined in the annular recess 55*a* and does not fall onto the polishing pad 2.

In the embodiment illustrated in FIG. 5, the outer seal 100A and the inner seal 100B are labyrinth seals. The outer seal 100A includes a first peripheral wall 101 disposed outside the circular rail 92 and a second peripheral wall 102 disposed outside the first peripheral wall 101. The first peripheral wall 101 extends upward from the roller housing 55 and is formed integrally with the roller housing 55. The second peripheral wall 102 extends downward from the rail base 94 and is formed integrally with the rail base 94. A very small gap is formed between the first peripheral wall 101 and the second peripheral wall 102. Similarly, the inner seal 100B includes the first peripheral wall 101 disposed inside the circular rail 92 and the second peripheral wall 102 disposed inside the first peripheral wall 101.

Figure 6:
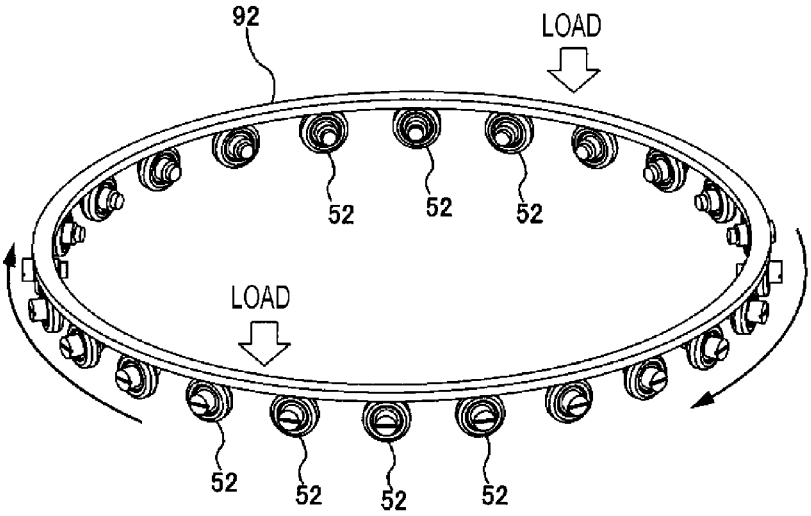
FIG. 6 is a perspective view illustrating a roller and a circular rail.
Figure 7:
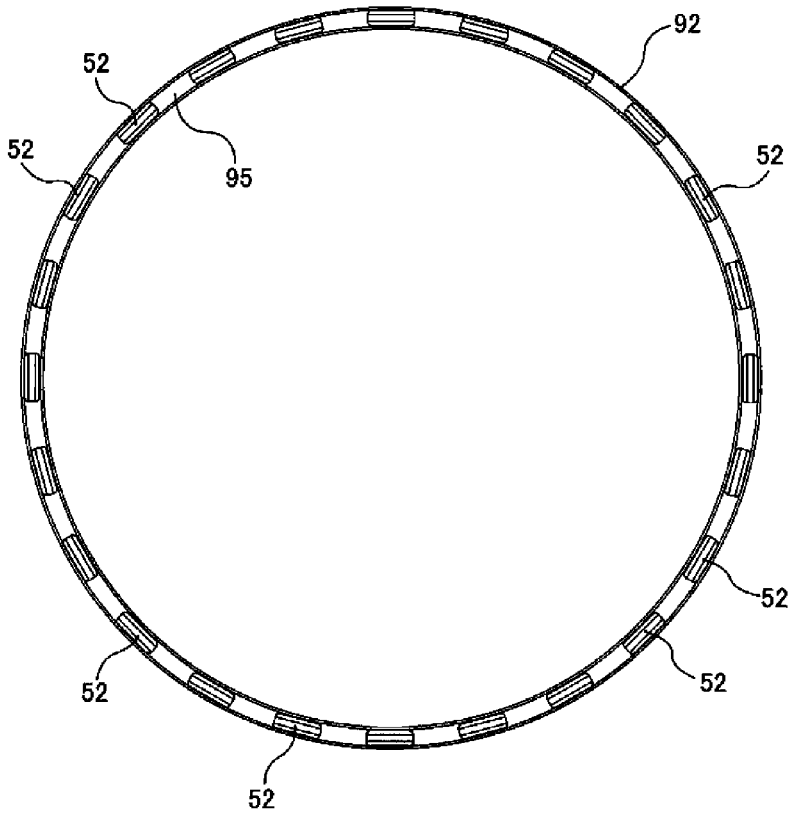
FIG. 7 is a view of the roller and the circular rail illustrated in FIG. 6 as viewed from below.

FIG. 6 is a perspective view illustrating the roller 52 and the circular rail 92, and FIG. 7 is a view of the roller 52 and the circular rail 92 illustrated in FIG. 6 as viewed from below. In the present embodiment, 24 rollers 52 are provided. During the polishing of the wafer, these rollers 52 rotate integrally with the retainer ring 20 while the circular rail 92 is stationary. Thus, each roller 52 is in rolling contact with the circular rail 92. With the configuration of the roller 52 described with reference to FIG. 5, the roller 52 may rotate smoothly and may transmit a load without damaging the circular rail 92. The load of the first local load applying device 30A and the second local load applying device 30B is transmitted from the circular rail 92 to the roller 52. The roller 52 receives the load only when passing through the point of application of the load.

The number of rollers 52 is determined based on the outer diameter of the rollers 52 and the diameter of the circular rail 92. In order to transmit the load smoothly, the number of rollers 52 may be increased as much as possible so that the interval between the rollers 52 is reduced. The rollers 52 have a smooth outer peripheral surface, and are in contact with the circular rail 92 with a wide contact area in order to enable transmission of a larger load. The circular rail 92 is placed on the rollers 52. The rollers 52 are in rolling contact with the circular rail 92. The lateral position of the circular rail 92 is guided by contact between the corners of the curved cross section of the rollers 52 and the corners of the curved cross section of the circular rail 92. In this case, the load of the first local load applying device 30A and the second local load applying device 30B is mainly transmitted from the circular rail 92 to the outer peripheral surface of the rollers 52.

Figure 8:
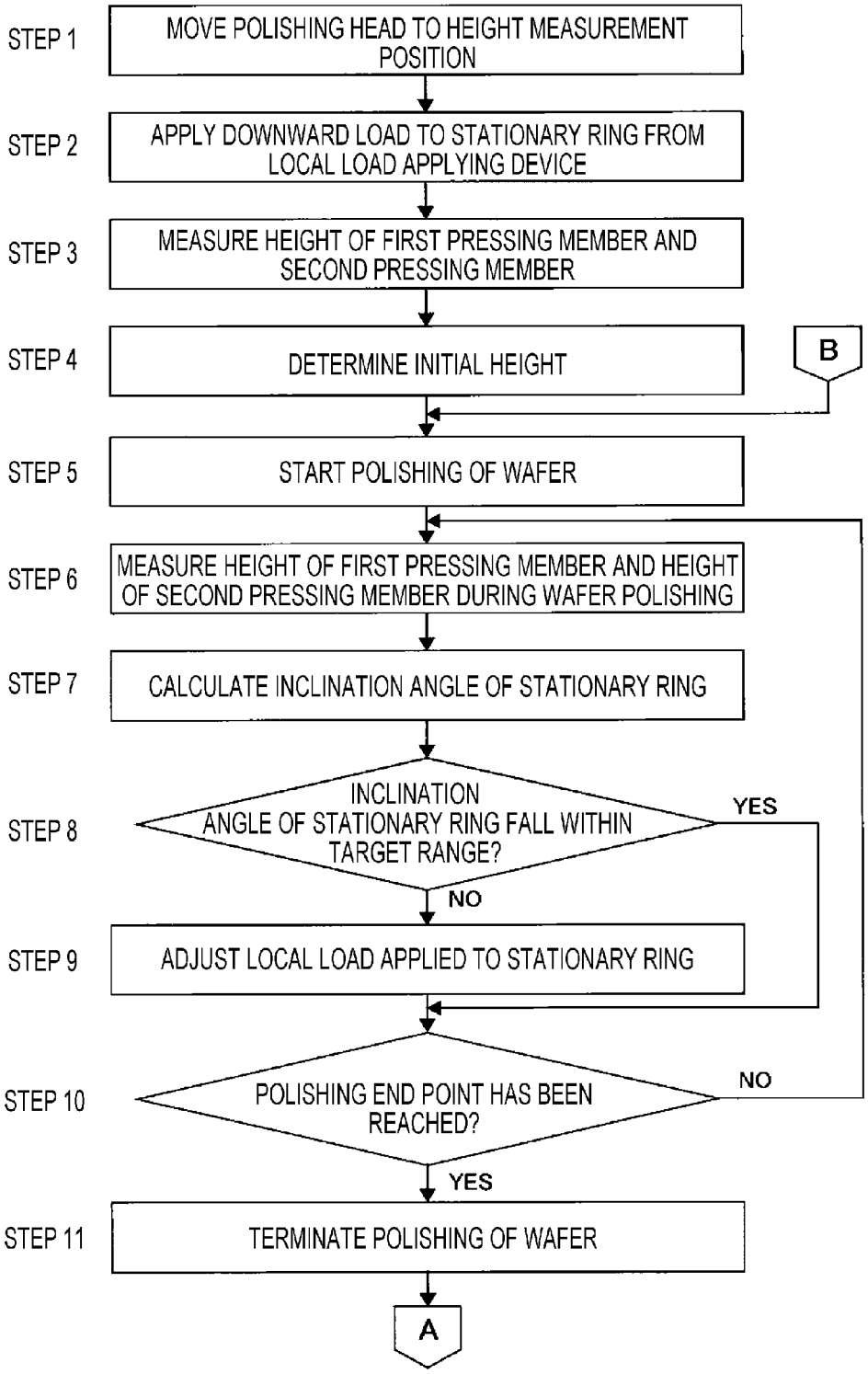
FIG. 8 is a flowchart for explaining an embodiment of a wafer polishing process.
Figure 9:
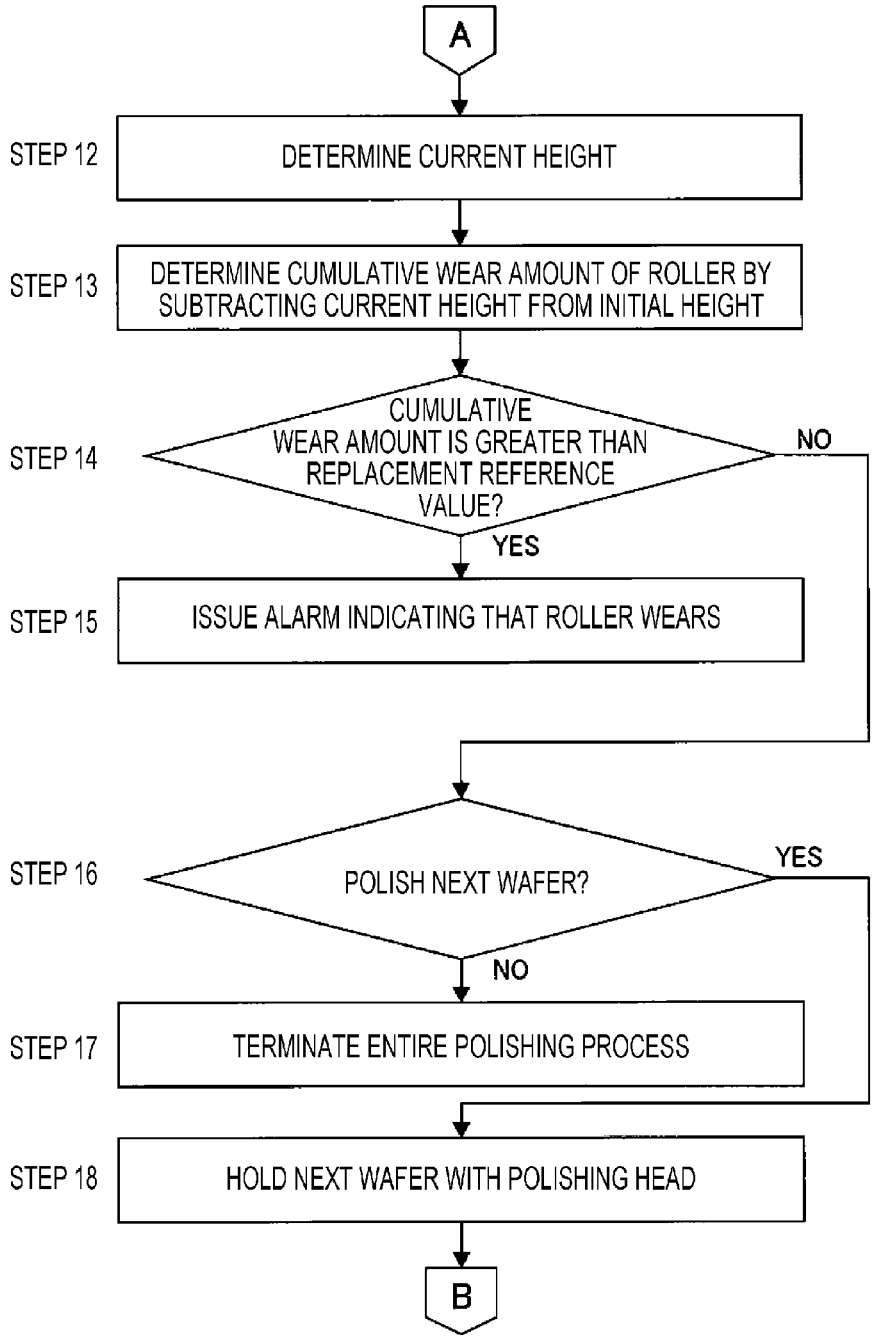
FIG. 9 is a flowchart for explaining an embodiment of a wafer polishing process.

FIGS. 8 and 9 are flowcharts for explaining an embodiment of a wafer polishing process. First, the initial height of the pressing members 31A and 31B is determined. That is, in step 1, the polishing head 10 is moved to a height measurement position before a first wafer is polished. The height measurement position is the vertical position of the polishing head 10 when the retainer ring 20 is not in contact with the polishing surface 2*a*. In one example, the height measurement position is a position several millimeters above the polishing surface 2*a* of the polishing pad 2.

In step 2, a downward load having a predetermined magnitude is applied to the stationary ring 91 by the local load applying devices 30A and 30B. Thus, the circular rail 92 of the stationary ring 91 is pressed against the top of the rollers 52, and the heights of the pressing members 31A and 31B may be stably measured in the next step.

In step 3, the displacement sensors 41A and 41B measure the heights of the pressing members 31A and 31B at the height measurement position.

In step 4, the controller 42 acquires two measured values of the heights of the pressing members 31A and 31B from the displacement sensors 41A and 41B, and determines the initial height of the first pressing member 31A and the second pressing member 31B based on the two measured values. More specifically, the controller 42 calculates the average of the two measured values as the initial height of the first pressing member 31A and the second pressing member 31B. In one embodiment, the controller 42 may acquire only the measured value of the height of a preselected one of the pressing members 31A and 31B from the first displacement sensor 41A or the second displacement sensor 41B. In this case, the measured value of the height of the preselected one of the pressing members 31A and 31B indicates the initial height of the preselected one of the pressing members 31A and 31B.

In step 5, the wafer is pressed against the polishing surface 2*a* of the polishing pad 2 so that polishing of the wafer is started. During the polishing of the wafer, the retainer ring 20 is in contact with the polishing surface 2*a* of the polishing pad 2 and presses the polishing pad 2 outside the wafer while rotating.

In step 6, the displacement sensors 41A and 41B measure the heights of the pressing members 31A and 31B during the polishing of the wafer, and the controller 42 acquires measured values of the heights of the pressing members 31A and 31B from the displacement sensors 41A and 41B.

In step 7, the controller 42 calculates the inclination angle of the stationary ring 91 based on the difference between the measured value of the height of the first pressing member 31A and the measured value of the height of the second pressing member 31B acquired during the polishing of the wafer.

In step 8, the controller 42 determines whether or not the inclination angle of the stationary ring 91 calculated in step 7 is within a target range. The target range is predetermined based on a desired polishing profile.

In step 9, when the inclination angle of the stationary ring 91 is outside the predetermined target range, the controller 42 issues a command to at least one of the first local load applying device 30A and the second local load applying device 30B to adjust the local load applied to the stationary ring 91 from at least one of the pressing member 31A and the pressing member 31B.

More specifically, the controller 42 issues a command to any one of the pressure regulators R1 and R2 to adjust the pressure of the compressed gas in the air cylinder 35A or the air cylinder 35B. For example, when it is desired to tilt the stationary ring 91 downward toward the upstream side, the controller 42 issues a command to the pressure regulator R1 to increase the pressure of the compressed gas in the air cylinder 35A. When it is desired to tilt the stationary ring 91 downward toward the downstream side, the controller 42 issues a command to the pressure regulator R2 to increase the pressure of the compressed gas in the air cylinder 35B.

After execution of step 9 or when the inclination angle of the stationary ring 91 is within the target range, the controller 42 determines whether or not the polishing end point of wafer polishing has been reached (step 10). The polishing termination condition is that the current polishing time is not less than a preset polishing termination time or that the film thickness of the wafer is not more than a desired film thickness. When the polishing end point of wafer polishing has not been reached, step 6 to step 9 are executed again. When the polishing end point of wafer polishing has been reached, the polishing of the wafer is terminated (step 11).

After the polishing of the wafer is terminated, the controller 42 determines the current height of the pressing members 31A and 31B according to the same process as in steps 1 to 4 (step 12). The current height is the height of at least one of the first pressing member 31A and the second pressing member 31B at the height measurement position measured after the polishing of the wafer. Specifically, the current height is the height the first pressing member 31A, the height of the second pressing member 31B, or the average of two measured values of the pressing members 31A and 31B at the height measurement position measured after the polishing of the wafer.

In step 13, the controller 42 determines the cumulative wear amount of the roller 52 by subtracting the current height from the initial height. As described above, during the polishing of the wafer, since each roller 52 is in rolling contact with the circular rail 92 while receiving a load from the circular rail 92, the roller 52 (the wheel 59 of the roller 52) gradually wears. The first wafer is polished using a new roller 52 (i.e., the roller 52 that does not wear).

In step 14, the controller 42 compares the cumulative wear amount of the roller 52 with a predetermined replacement reference value. When the wear amount of the roller 52 is greater than the replacement reference value, the controller 42 issues an alarm (step 15). A user may know the appropriate replacement time of the roller 52, which is a consumable item, from the alarm issued from the controller 42.

When the wear amount of the roller 52 is equal to or less than the replacement reference value, the controller 42 determines whether or not to polish the next wafer (step 16). When the next wafer is not polished, the entire polishing process is terminated (step 17). When polishing the next wafer, the next wafer is held by the polishing head 10 (step 18), and the process of step 5 to step 16 is executed.

According to each embodiment described above, the controller 42 calculates the inclination angle of stationary ring 91 based on the height of at least one of the pressing members 31A and 31B connected to the stationary ring 91. The polishing apparatus 1 may accurately control the inclination of the retainer ring 20 based on the inclination angle of the stationary ring 91. Furthermore, the user may know the appropriate replacement time of the roller 52, which is a consumable item, from the cumulative wear amount of the roller 52, and may manage the consumable item to suit with the polishing process.

In one embodiment, a cover may be mounted to the displacement sensors 41A and 41B to prevent adhesion of slurry or abrasive powder.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A polishing apparatus comprising:

a rotatable head body having a pressing surface configured to press a substrate against a polishing surface;

a retainer ring disposed to surround the pressing surface and configured to press the polishing surface while rotating together with the head body;

a rotational ring vertically stacked and fixed to the retainer ring and configured to be rotatable together with the retainer ring;

a stationary ring disposed on the rotational ring and configured to be stationary throughout rotation of the retainer ring and the rotational ring;

a plurality of local load applicators each configured to apply a local load to the stationary ring and the retainer ring, and change an inclination angle of the retainer ring; and a controller configured to control an operation of the polishing apparatus, wherein each of the plurality of local load applicators includes a first pressing member and a second pressing member connected to the stationary ring, a first actuator connected to the first pressing member, a second actuator connected to the second pressing member, and at least one displacement sensor configured to measure a height of at least one of the first pressing member and the second pressing member, the first pressing member is disposed in an upstream side of the retainer ring in a traveling direction of the polishing surface, and the second pressing member is disposed in a downstream side of the retainer ring in the traveling direction of the polishing surface, and the controller is configured to calculate an inclination angle of the stationary ring based on a measured value of the height of at least one of the first pressing member and the second pressing member during polishing of the substrate.

2. The polishing apparatus according to claim 1, wherein the at least one displacement sensor includes a first displacement sensor configured to measure a height of the first pressing member and a second displacement sensor configured to measure a height of the second pressing member, and the controller is configured to calculate the inclination angle of the stationary ring based on a difference between a measured value of the height of the first pressing member and a measured value of the height of the second pressing member during polishing of the substrate.

3. The polishing apparatus according to claim 1, wherein the controller is configured to issue a command to at least one of the first actuator and the second actuator so as to adjust the local load applied to the stationary ring from at least one of the first pressing member and the second pressing member until the inclination angle of the stationary ring falls within a target range.

4. The substrate processing apparatus according to claim 1, wherein the first actuator includes a first air cylinder mounted to a first base and a first piston rod connected to a first bridge, the first bridge being connected to the stationary ring via the first pressing member.

5. The substrate processing apparatus according to claim 4, wherein the at least one displacement sensor is connected to the first pressing member via a first guide rod and the first bridge.

6. A method of polishing a substrate using a polishing apparatus, the method comprising:

providing a retainer ring disposed to surround a pressing surface of a head body, a rotational ring vertically stacked and fixed to the retainer ring and configured to be rotatable together with the retainer ring, and a stationary ring disposed on the rotational ring;

pressing the substrate against a polishing surface by the pressing surface of the head body while rotating the head body and pressing the retainer ring against the polishing surface while rotating the retainer ring together with the head body and the substrate;

applying a local load from a first pressing member or a second pressing member to the stationary ring and the retainer ring while rotating the rotational ring together with the retainer ring and changing an inclination angle of the retainer ring;

calculating an inclination angle of the stationary ring based on a measured value of a height of at least one of the first pressing member and the second pressing member during polishing of the substrate; and adjusting the local load applied to the stationary ring from at least one of the first pressing member and the second pressing member during polishing of the substrate until the inclination angle falls within a target range.

7. The method according to claim 6, wherein the calculating the inclination angle of the stationary ring is calculating the inclination angle of the stationary ring based on a difference between the measured value of the height of the first pressing member and the measured value of the height of the second pressing member during polishing of the substrate.

* * * * *